United States Patent [19]

McElroy et al.

[11] 4,337,029

[45] Jun. 29, 1982

[54] PILOT BURNER ASSEMBLY

[75] Inventors: Jerry W. McElroy, St. Louis; Donald C. Urban, Florissant, both of Mo.

[73] Assignee: Emerson Electric Co., St. Louis, Mo.

[21] Appl. No.: 135,166

[22] Filed: Mar. 28, 1980

[51] Int. Cl.[3] ..... F23N 5/10; F23Q 3/00

[52] U.S. Cl. ..... 431/264; 431/80; 431/343; 174/153 G; 248/65

[58] Field of Search ..... 431/78, 80, 263, 264, 431/343; 219/138, 144; 136/217, 230, 242; 174/152 G, 153 G; 248/65, 300

[56] References Cited

U.S. PATENT DOCUMENTS

| | | | |
|---|---|---|---|
| 2,667,920 | 2/1954 | Smith | 431/78 |
| 3,511,588 | 5/1970 | Wolfe et al. | 431/264 |
| 3,519,491 | 7/1970 | Grohall et al. | 431/80 |
| 3,930,891 | 1/1976 | Fox et al. | 431/80 |
| 4,177,034 | 12/1979 | Jones | 431/264 |

FOREIGN PATENT DOCUMENTS

| | | | |
|---|---|---|---|
| 2223009 | 12/1972 | Fed. Rep. of Germany | 431/264 |
| 156808 | 5/1978 | Netherlands | 431/264 |

*Primary Examiner*—Samuel Scott
*Assistant Examiner*—Lee E. Barrett
*Attorney, Agent, or Firm*—Paul A. Becker, Sr.

[57] ABSTRACT

A pilot burner assembly comprises a pilot burner, a flame responsive means, and an electrode, all attached in close relationship to a common mounting bracket. The electrode is frictionally attached co-axially with an insulating sleeve and the sleeve is frictionally attached to the mounting bracket so that the spark gap between the tip of the electrode and a portion of the pilot burner is adjustable without having to bend the electrode.

4 Claims, 6 Drawing Figures

PILOT BURNER ASSEMBLY

This invention relates to pilot burner assemblies and, more particularly, to an improved construction of a pilot burner assembly of the type wherein a spark electrode effects ignition of the pilot burner.

For many years, it has been conventional to provide a constantly-burning pilot burner flame to ignite a main gas burner. In such systems, commonly called standing-pilot systems, the pilot burner assembly comprises the pilot burner and a thermocouple mounted on a supporting bracket. The pilot burner and thermocouple are positioned with respect to each other so that the pilot burner flame impinges the thermocouple, enabling the thermocouple to provide the necessary electrical power to maintain a safety valve open. Should the pilot burner flame be extinguished, the safety valve closes. This closure shuts off all gas flow so that no gas can flow to the main burner in the absence of a pilot burner flame needed to effect ignition of the main burner.

Primarily due to the need for conserving energy, systems have been recently developed which eliminate the waste of energy due to a constantly-burning pilot burner flame, but which maintain the reliability of main burner ignition by a pilot burner flame. Such systems, sometimes referred to as cycling-pilot systems, incorporate a pilot burner assembly in which the pilot burner flame is established only when main burner operation is required. In such systems, the pilot burner assembly includes the pilot burner, means for igniting the pilot burner, and means responsive to pilot burner flame. When pilot burner flame exists, the means responsive to pilot burner flame is effective to enable gas to flow to the main burner where it is ignited by the pilot burner flame.

While the pilot burner assemblies for cycling-pilot systems can incorporate various ignition means, a particularly popular construction employs a spark electrode. It is to such construction that the present invention is particularly directed.

In a pilot burner assembly which utilizes a spark electrode, the high-voltage electrode must be mounted so that its tip is properly spaced from the grounded pilot burner or flame responsive means so that reliable sparking will occur. Also, the flame responsive means must be properly located with respect to the pilot burner so that it will be responsive to the pilot burner flame.

In some commercially available pilot burner assemblies, the proper electrode spacing or spark gap is obtained by bending the electrode toward or away from the pilot burner or flame responsive means until the proper gap is obtained. While such bending may provide the desired spark gap, it is considered to be difficult, time-consuming, and expensive. In other available pilot burner assemblies, the electrode is not bent, but the spark gap is predetermined by the physical configuration of the electrode assembly, such as a locating step or shoulder on the electrode assembly which cooperates with an opening in the pilot burner assembly mounting bracket. In such a construction, there appears to be no means for adjusting the location of the electrode assembly to effect a change in the spark gap.

An object of this invention is to provide a generally new and improved pilot burner assembly of the type utilizing a spark electrode, wherein the spark gap is adjustable without having to bend the electrode.

A further object of this invention is to provide a pilot burner assembly as in the preceding paragraph wherein the electrode is frictionally mounted within an insulative portion of an electrode assembly and wherein the electrode assembly is frictionally attached to a pilot burner assembly mounting bracket.

A further object is to provide a pilot burner assembly as in the preceding paragraph wherein the electrode assembly includes means for effecting a rigid electrical connection between the electrode and a high voltage lead wire.

A further object is to provide a pilot burner assembly of the type utilizing a spark electrode and a liquid-filled bulb type flame responsive means wherein means are provided for enabling alternate mounting locations for the bulb.

A further object is to provide a pilot burner assembly of the type utilizing a spark electrode, which assembly is particularly versatile and inexpensive to manufacture.

These and other objects and advantages of the present invention will become apparent from the following description when read in connection with the accompanying drawings.

In the drawings:

FIG. 1. is a front elevation view of the pilot burner assembly of the present invention;

FIG. 2. is a top plan view of the pilot burner assembly of FIG. 1;

FIG. 3. is a top plan view of the spring clip for attaching the orifice screw;

FIG. 4. is an enlarged cross-sectional view of the electrode assembly taken along line 4—4 of FIG. 1;

FIG. 5. is a top plan view of the pilot burner assembly for FIG. 1 shown with the flame responsive means, electrode assembly, and orifice removed, and showing, by dotted lines, alternate locations of an opening for mounting the flame responsive means and an alternate orientation of the pilot burner; and FIG. 6. is a top plan view similar to FIG. 5 shown with a pilot burner of another configuration.

DESCRIPTION OF THE PREFERRED EMBODIMENT

Figure 1:
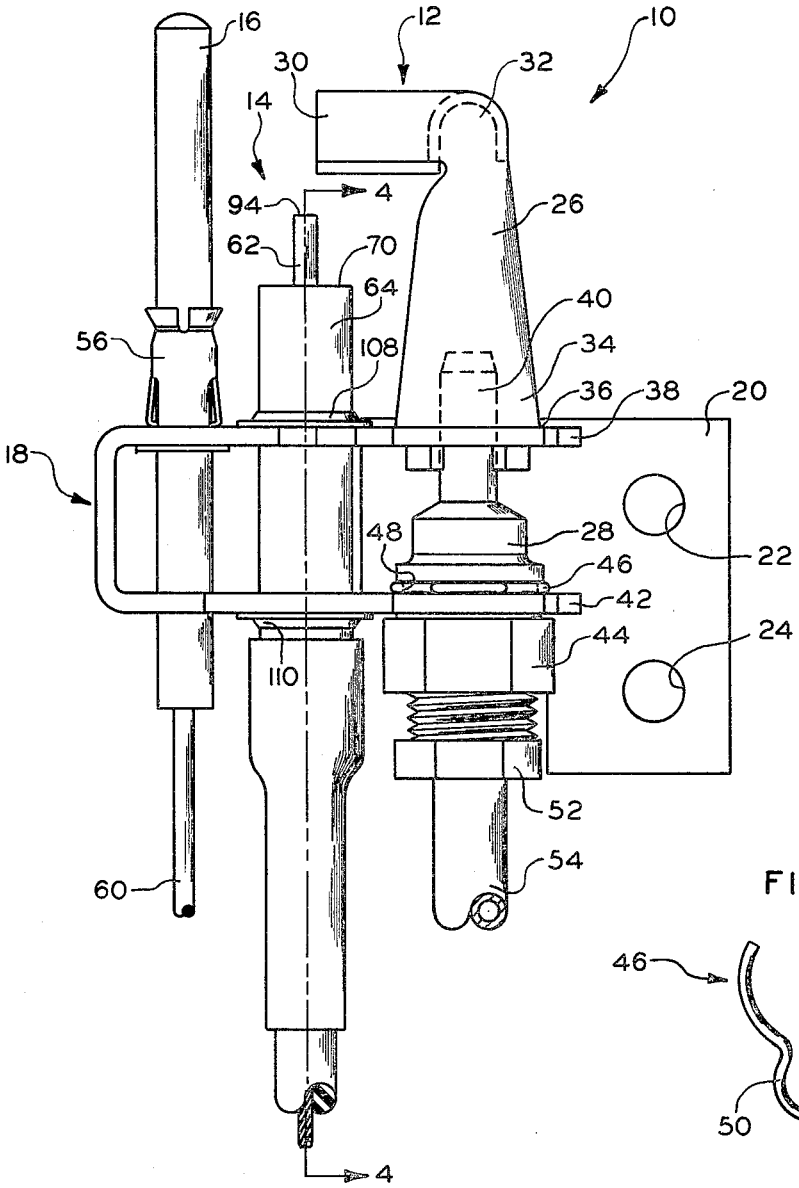

Referring to FIG. 1, a pilot burner assembly is indicated generally at 10 and includes a pilot burner 12, an electrode assembly 14, a flame responsive means comprising a liquid-filled bulb 16, and a U-shaped pilot burner assembly mounting bracket 18 to which pilot burner 12, electrode assembly 14, and bulb 16 are attached. Pilot burner assembly 10 also includes a mounting bracket 20 attached to bracket 18 and having holes 22 and 24 for receiving screws (not shown) for attaching pilot burner assembly 10 in igniting relationship to a main burner (not shown).

Figure 2:
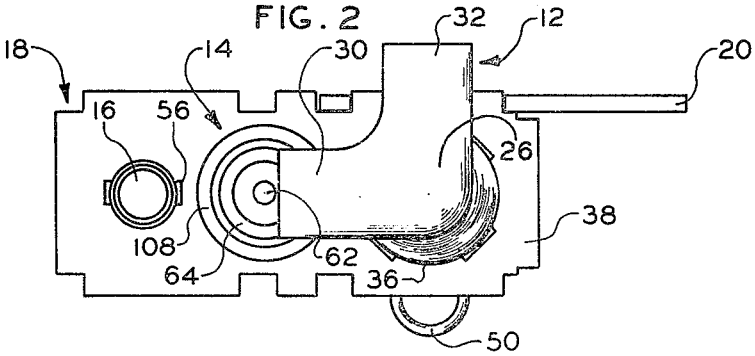

Pilot burner 12 comprises a guard 26 and an orifice screw 28. As shown more clearly in FIG. 2, guard 26 includes a first upper portion 30 and a second upper portion 32 for directing flame in two different directions. First upper portion 30 is in close relationship to electrode assembly 14, for reasons to be hereinafter described, and directs flame towards and impinges bulb 16. Second upper portion 32 directs flame towards the main burner to effect ignition thereof.

Figure 3:
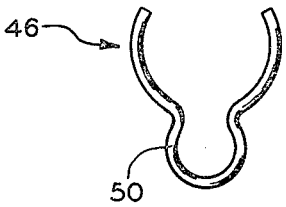

A lower portion 34 of guard 26 is securely attached at 36 to an upper leg 38 of bracket 18 by any suitable means such as by welding, and telescopically receives an upwardly extending portion 40 of orifice screw 28. Orifice screw 28 extends upwardly through an opening in a lower leg 42 of bracket 18. A hexagonal portion 44 of orifice screw 28 is sufficiently larger than the opening in lower leg 42 so as to limit the amount that orifice screw 28 extends upwardly. A resilient spring clip 46, whose configuration is shown more clearly in FIG. 3, cooperates with a reduced diameter portion 48 of orifice screw 28 and the top surface of lower leg 42 to removably attach orifice screw 28 to bracket 18. Clip 46 is provided with a circular loop 50 which extends slightly beyond bracket 18, as shown more clearly in FIG. 2, to facilitate removal of clip 46 in the event that orifice screw 28 is to be removed for cleaning or for replacement by a different orifice screw. A conventional compression fitting 52 is utilized to attach gas tubing 54 from a gas source (not shown) to orifice screw 28.

Figure 5:
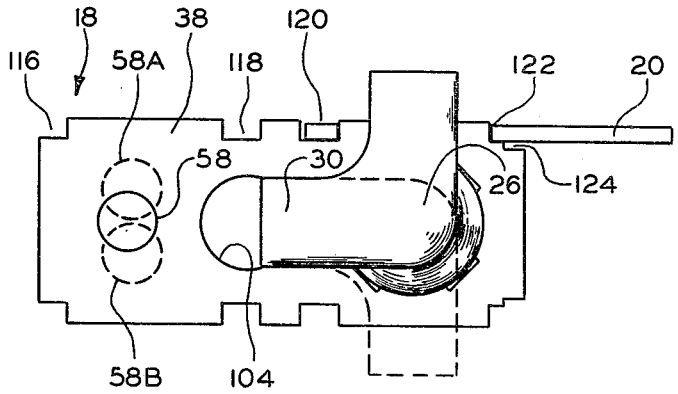

Liquid-filled bulb 16 extends through an opening in lower leg 42 of bracket 18 and is secured to bracket 18 by means of a cylindrical clamp 56 which is mounted in an opening 58, such opening 58 shown in FIG. 5, in upper leg 38 of bracket 18. Bulb 16 is filled with an expansible liquid, preferably mercury. When bulb 16 is impinged by flame from pilot burner 12, the mercury therein expands. This expansion causes expansion of a diaphragm chamber (not shown) which is fluidically connected to bulb 16 through a hollow tube 60. Such diaphragm chamber expansion effects the flow of gas to the main burner, a function well known in the art and a function which may be provided by a number of various well known constructions.

Figure 4:
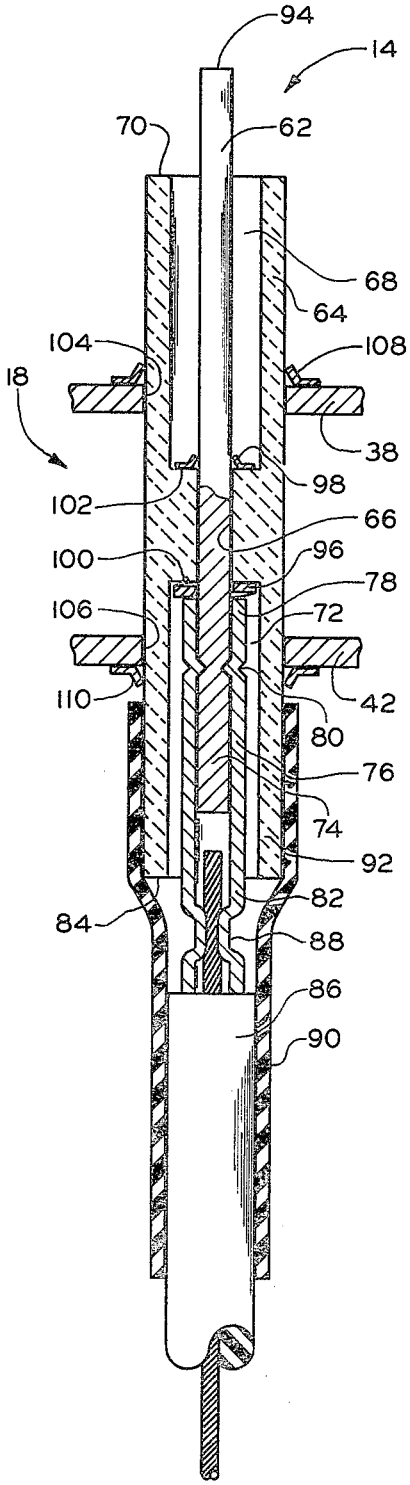

Referring to FIG. 4, electrode assembly 14 includes a stainless steel electrode 62 adjustably secured to and co-axial with an electrically insulative sleeve 64. Sleeve 64 can be manufactured from any suitable high grade ceramic composition.

Electrode 62 extends through an inner bore 66 of sleeve 64 and upwardly through an enlarged diameter top cavity 68 of sleeve 64, past a top edge 70 thereof. Electrode 62 also extends downwardly from inner bore 66 of sleeve 64 into an enlarged diameter bottom cavity 72 of sleeve 64.

Telescopically receiving a bottom portion 74 of electrode 62 is a hollow, stainless steel tube 76. A top portion 78 of tube 76 is rigidly connected, as by staking at 80, to bottom portion 74 of electrode 62. A bottom portion 82 of tube 76 extends downwardly beyond a bottom edge 84 of sleeve 64. A stripped end of an insulated stranded-wire cable 86 is rigidly attached, as by crimping at 88, to bottom portion 82 of tube 76. Cable 86 is connected at its other end to spark generating means (not shown). An electrically-insulative boot 90 is attached to a bottom portion 92 of sleeve 64 and a portion of cable 86 so as to insulate the staked connection 88 from surrounding equipment. Preferably, boot 90 is of a shrinkable type which shrinks when it is removed from its protective packaging and is exposed to normal ambient conditions.

The distance that the tip 94 of electrode 62 extends beyond the top edge 70 of sleeve 64 is adjustable by inserting more or less of the bottom portion 74 of electrode 62 into the top portion 78 of tube 76 before making the staking connection 80. After the staking connection 80 is made, the desired distance between tip 94 and top edge 70 of sleeve 64 is rigidly maintained by a lockwasher 96 and a friction ring 98. Specifically, lock washer 96 is sandwiched between the top portion 78 of tube 76 and a wall 100 of bottom cavity 72 in sleeve 64, and ring 98 is frictionally secured to electrode 62 and abuts a wall 102 of top cavity 68 in sleeve 64.

Lock washer 96 is preferable over a simple flat washer. Specifically, when ring 98 is attached, lock washer 96 can be essentially flattened. When the force required to attach ring 98 is released and ring 98 relaxes somewhat, lock washer 96 also relaxes somewhat, retaining sufficient bias, however, to prevent any subsequent vertical or rotational movement of electrode 62 within inner bore 66 of sleeve 64 which might normally occur due to dimensional changes effected by extreme temperature variations encountered in use.

As shown in FIG. 4, electrode assembly 14 extends through openings 104 and 106 of upper leg 38 and lower leg 42, respectively, of bracket 18. A friction ring 108 secures sleeve 64 in abutment with the top surface of upper leg 38 of bracket 18, and a friction ring 110 secures sleeve 64 in abutment with the bottom surface of lower leg 42 of bracket 18.

Referring to FIG. 1, electrode assembly 14 is attached to bracket 18 in such a manner that the desired spark gap is established between tip 94 of electrode 62 and guard 26 without bending electrode 62. Also, sleeve 64 extends sufficiently above bracket 18 to preclude sparking between electrode 62 and bracket 18. A preferred method of assembly to ensure such results will now be described.

When it is known that guard 26 will be utilized, tube 76 is staked to electrode 62 at a predetermined position which will result in a desired spark gap, and which will ensure that when the desired spark gap is established, the top edge 70 of sleeve 64 will be sufficiently spaced from bracket 18 to preclude sparking between electrode 62 and bracket 18. Lock washer 96 and friction ring 98 are then attached. This assembly is then inserted through openings 106 and 104 in lower leg 42 and upper leg 38 of bracket 18, respectively, and through friction ring 108 which is held by a tooling fixture (not shown) against the top surface of upper leg 38 of bracket 18. The assembly is then moved upwardly until the desired spark gap is established between the tip 94 of electrode 62 and the first upper portion 30 of guard 26. Friction ring 110 is then installed. With friction rings 108 and 110 installed, sleeve 64 is precluded from any subsequent vertical movement. Electrode assembly 14 is then completed by crimping bottom portion 82 of tube 76 to the stripped end of cable 86, placing boot 90, in an unshrunk condition, over cable 86, and then sliding boot 90 along cable 86 until it extends over bottom portion 92 of sleeve 64.

Figure 6:
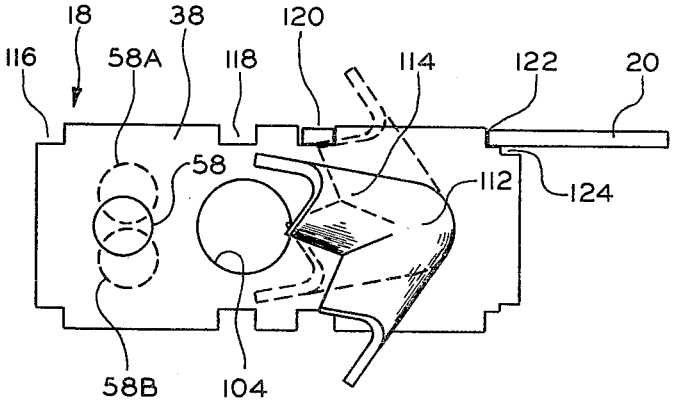

When it is known that a different guard, such as guard 112 in FIG. 6, will be utilized, tube 76 is staked to electrode 62 at a different predetermined position to again ensure a proper spark gap and sufficient distance between top edge 70 of sleeve 64 and bracket 18. As is evident when comparing FIGS. 5 and 6, a first upper portion 114 of guard 112, to which electrode 62 is to spark, is spaced differently with respect to opening 104, in which electrode assembly 14 is to be secured, than is first upper portion 30 of guard 26. This different spacing requires that the tip 94 of electrode 62 be vertically spaced from upper leg 38 of bracket 18 a different amount than when guard 26 is utilized. This different vertical spacing is achieved by staking tube 76 to electrode 62 at a different position so that the distance between top edge 70 of sleeve 64 and bracket 18 remains essentially the same as it is when guard 26 is utilized, while the distance between the tip 94 of electrode 62 and the upper leg 38 of bracket 18 is changed to accommodate guard 112.

The above described construction of electrode assembly 14 and the means of attaching it to bracket 18 thus provides two means for adjusting the spark gap. The first means, involving staking of the tube 76 to electrode 62 at different positions and the use of friction ring 98 and lock washer 96, establishes a spark gap and more than adequate spacing between the top edge 70 of sleeve 64 and bracket 18, and is determined by the known physical configuration of the guard to be used. The second means, involving utilization of friction ring 108, enables a fine adjustment of the spark gap to the desired value. This second adjustment means thus compensates for dimensional variations that may occur in the manufacturing of guards 26 and 112, and in the assembly of guards 26 and 112 to bracket 18.

For proper operation of pilot burner assembly 10, sparking must occur between the tip 94 of electrode 62 and pilot burner 12 to ignite the gas, and the resulting pilot burner flame must impinge bulb 16 and also ignite the main burner. To ensure that the pilot burner flame will ignite the main burner, bracket 18 is provided with a plurality of cut-out portions typified by portions 116, 118, 120, 122 and 124 shown in FIGS. 5 and 6, to which bracket 20 or other mounting brackets can be selectively attached. Such versatility in mounting ensures that the pilot burner flame will be properly directed so as to ignite the main burner.

Referring to FIG. 5, guard 26 can be attached to bracket 18 as shown or can be attached as shown by dotted lines. Similarly, as shown in FIG. 6, guard 112 can be attached as shown or as shown by dotted lines. Such alternate positions maintain the required spark gap between the tip 94 of electrode 62 and guards 26 and 112 and provide alternate directions for the pilot burner flame whereby versatility in mounting is further enhanced.

To ensure that the pilot burner flame will impinge bulb 16, provision is made in the tooling of bracket 18 to locate opening 58 at the position shown or at either of the dotted positions indicated at 58A and 58B in upper leg 38 of bracket 18 in FIGS. 5 and 6. Although not shown, the same provision of openings is provided in the lower leg 42 of bracket 18.

The provision of such variable mounting locations for bulb 16 has several advantages. One advantage is that it can compensate for various conditions on the application which tend to deflect the pilot burner flame from its expected direction. For example, in FIG. 5, the expected direction of flame would indicate that bulb 16 should be secured in opening 58. However, should pilot burner assembly 10 be mounted in a different orientation or should there be excessive air-movement in the application, the direction of the pilot burner flame may be such thatthe bulb 16, to be impinged, must be located at opening 58A or 58B.

Another advantage of the provision of variable mounting locations for bulb 16 is that it enables the same mounting bracket 18 to be used with other guards such as guard 112 of FIG. 6 wherein the expected direction of the pilot burner flame would indicate that bulb 16 should be secured in opening 58A. Furthermore, when guard 112 is secured to bracket 18 in the position indicated by dotted lines, the expected direction of the pilot burner flame would indicate that bulb 16 sould be secured in opening 58B.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a pilot burner assembly,

U-shaped mounting bracket having an upper leg and a lower leg, each said leg having first, second, and third openings therein;

a pilot burner comprising a guard rigidly attached to said upper leg at said first opening therein, and an orifice screw extending through said first opening in said lower leg of said bracket, said orifice screw being telescopically received by said guard and removably attached to said lower leg;

a spark electrode assembly including a straight electrode co-axial with an insulating sleeve, wherein a tip of said electrode and a portion of said guard define a spark gap, and wherein said electrode tip extends a distance beyond an edge of said sleeve, said spark electrode assembly further including an electrically conductive tube telescopically receiving and rigidly connected to a portion of said electrode within said sleeve so as to adjustably establish said distance that said electrode tip extends beyond an edge of said sleeve, and means cooperative with said electrode, tube, and sleeve for rigidly maintaining said distance;

means for adjusting said spark gap comprising means for frictionally attaching said sleeve to said second openings in said upper and lower legs of said bracket; and flame responsive means extending through said third openings in said upper and lower legs of said bracket and securely attached to at least one of said third openings and disposed so as to be impinged by a flame from said pilot burner.

2. The pilot burner assembly claimed in claim 1 wherein the location of said third openings in said upper and lower legs of said bracket is adjustable.

3. In a pilot burner assembly having a pilot burner, an electrode assembly, and a flame responsive means, all mounted on a common bracket, an improved electrode assembly for effecting sparking to the pilot burner so as to ignite gas, comprising:

an insulative sleeve having a through bore and top and bottom cavities therein;

an electrode extending through said bore and having a bottom portion extending into said bottom cavity and a top portion extending through said top cavity and having a tip which extends a distance beyond a top edge of said sleeve;

an electrically conductive tube in said bottom cavity and extending beyond a bottom edge of said sleeve, said tube telescopically receiving said bottom portion of said electrode and rigidly connected thereto so as to adjustably establish said distance that said electrode tip extends beyond said top edge of said sleeve;

means for frictionally securing said connected electrode and tube in said bore so as to preclude further movement of said electrode with respect to said sleeve;

an insulated cable having a stripped end rigidly connected to said tube at a point beyond said bottom edge of said sleeve;

an electrically insulative boot attached to said sleeve and said cable for insulating said connection of said tube and cable; and means for frictionally securing said sleeve to the mounting bracket so as to enable adjustment of a distance between said tip of said electrode and the pilot burner without bending said electrode.

4. The electrode assembly claimed in claim 3 wherein said means for frictionally securing said connected electrode and tube in said bore comprises a friction ring and a lock washer, said friction ring being attached to said electrode and abutting a portion of said sleeve in said top cavity therein, and said lock washer being biased between said tube and a portion of said sleeve in said bottom cavity therein.

* * * * *